US006769240B2

(12) United States Patent
Roy et al.

(10) Patent No.: US 6,769,240 B2
(45) Date of Patent: Aug. 3, 2004

(54) METHOD AND APPARATUS FOR REMOVING BROKEN FILAMENTS

(75) Inventors: Douglas S. Roy, Knoxville, TN (US); James M. Clark, Lenoir City, TN (US)

(73) Assignee: Fortafil Fibers, Inc., Rockwood, TN (US)

( * ) Notice: Subject to any disclaimer, the term of this patent is extended or adjusted under 35 U.S.C. 154(b) by 108 days.

(21) Appl. No.: 10/168,861

(22) PCT Filed: May 17, 2001

(86) PCT No.: PCT/US01/16176

§ 371 (c)(1),
(2), (4) Date: Jun. 25, 2002

(87) PCT Pub. No.: WO01/88238

PCT Pub. Date: Nov. 22, 2001

(65) Prior Publication Data

US 2003/0029009 A1 Feb. 13, 2003

Related U.S. Application Data

(60) Provisional application No. 60/205,965, filed on May 19, 2000, now abandoned.

(51) Int. Cl.[7] ..... D02J 7/00

(52) U.S. Cl. ..... 57/305; 19/263

(58) Field of Search ..... 425/215; 28/282; 19/263; 57/304, 305

(56) References Cited

U.S. PATENT DOCUMENTS

| | | | | | |
|---|---|---|---|---|---|
| 2,425,576 | A | * | 8/1947 | Thoma | 19/263 |
| 2,893,196 | A | * | 7/1959 | Struber | 57/305 |
| 3,162,004 | A | * | 12/1964 | Hogg et al. | 57/305 |
| 4,689,947 | A | * | 9/1987 | Winckler | 57/304 |

* cited by examiner

*Primary Examiner*—Robert B. Davis
(74) *Attorney, Agent, or Firm*—Pitts & Brittian, P.C.

(57) ABSTRACT

A method and apparatus are provided for removing broken filaments from a continuous filament tow (60) traveling at a tow velocity between a source and a collector. The tow (60) is contacted with a rotatable, cylindrical roller (13), having an axis of rotation and an outer surface, located in the path of travel by the tow from the source to the collector. The axis of rotation is oriented generally perpendicular to the direction of travel of the tow (60). The roller (13) rotates in a direction counter to the direction of travel of the tow (60) to lift broken fibers from the tow. The lifted broken fibers are entrained in an airflow created by a tubular vacuum header (12) to remove the broken fibers from the tow.

16 Claims, 2 Drawing Sheets

METHOD AND APPARATUS FOR REMOVING BROKEN FILAMENTS

Priority is claimed to Provisional Application Number 60/205,965 filed May 19, 2000, now abandoned.

CROSS-REFERENCE TO RELATED APPLICATIONS

STATEMENT REGARDING FEDERALLY SPONSORED RESEARCH OR DEVELOPMENT

Not applicable

TECHNICAL FIELD

The present invention relates generally to the field of continuous high tensile modulus fibers and more particularly to a method and apparatus for removing broken filaments from fiber tows.

BACKGROUND OF THE INVENTION

It is common today to use carbon fiber formed from polyacrylonitrile in a continuous fiber tow or bundle form in applications such as prepegging, filament winding and pultrusion, where high tensile modulus fibers are desired. In these applications it is frequently important that the tow have a very low content of broken filaments. Broken filaments are exhibited as a readily visible fuzz that protrudes from the surface of the fiber bundle. Unacceptable amounts of fuzz lead to a variety of problems for the end-user, such as airborne fly, restriction of processing guides, imperfections in the surface of the finished product and in some cases degradation in the mechanical performance of the finished product.

Within the carbon fiber industry it is typical to measure the fuzz content in terms of the weight of fuzz removable from a specific length of tow by a recognized test procedure in which the tow is passed between two surfaces, at least one of which is a stationary foam pad capable of capturing the broken filaments while leaving the continuous fibers intact. In many applications, acceptable levels of fuzz should be less than 30 mg of fuzz per 150 feet of tow for tows with filament counts above 25,000. However, given the current qualities of polyacrylonitrile, carbon fiber tows manufactured therefrom have typical fuzz levels exceeding 50 mg per 150 feet of tow.

Accordingly, it is an object of the present invention to provide a method and apparatus for removing broken filaments from a carbon fiber tow.

It is also an object to provide a method and apparatus for reducing the fuzz level in a carbon fiber tow.

It is a further object to provide a method and apparatus for continuously removing broken filaments from a continuous carbon fiber tow.

These and other objects of the present invention will become apparent upon a consideration of the drawings referred to hereinafter and a complete description thereof.

SUMMARY OF THE INVENTION

In accordance with the present invention, as a tow moves from a station at which sizing is applied and dried to a collection station, the tow frictionally engages a rotating roller oriented in a position such that the axis of rotation is generally perpendicular to the direction of motion of the tow. The sizing may comprise an epoxy, other thermosets, such as phenolic, polyurethanes, vinylesters or polyesters, or thermoplastics, such as polyurethanes, polypropylene, polyamide or polyester. The roller rotates in a direction opposite to the direction of movement of the tow at the point of frictional engagement. The exterior surface of the roller is covered with a rubber material adapted to engage broken ends of fibers and direct those broken fibers to a vacuum nozzle located adjacent to the roller for collection of the broken fibers in a vacuum canister. The use of vacuum alone is not sufficient to remove broken filaments.

BRIEF DESCRIPTION OF THE DRAWINGS

The above-mentioned features of the invention will become more clearly understood from the following detailed description of the invention read together with the drawings in which.

PREFERRED MODE FOR CARRYING OUT THE INVENTION

Figure 1:
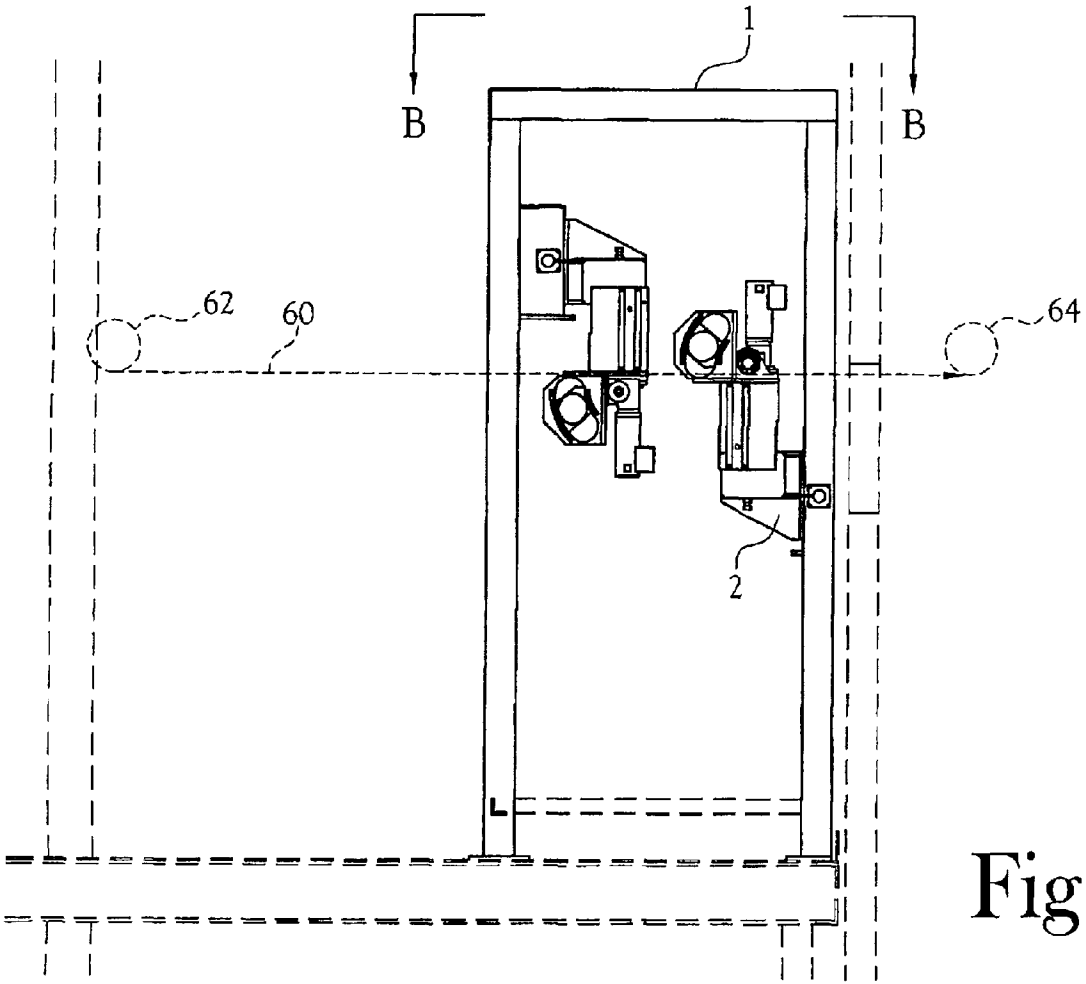
FIG. 1 is an elevation view of an apparatus for removing broken filaments in accordance with the present invention.
Figure 3:
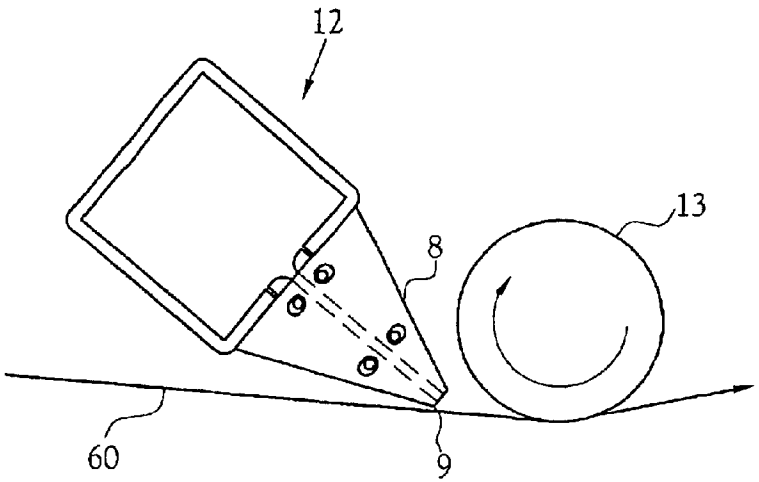
FIG. 3 is a cross-sectional view of a vacuum nozzle taken along line C—C in FIG. 2.
Figure 2:
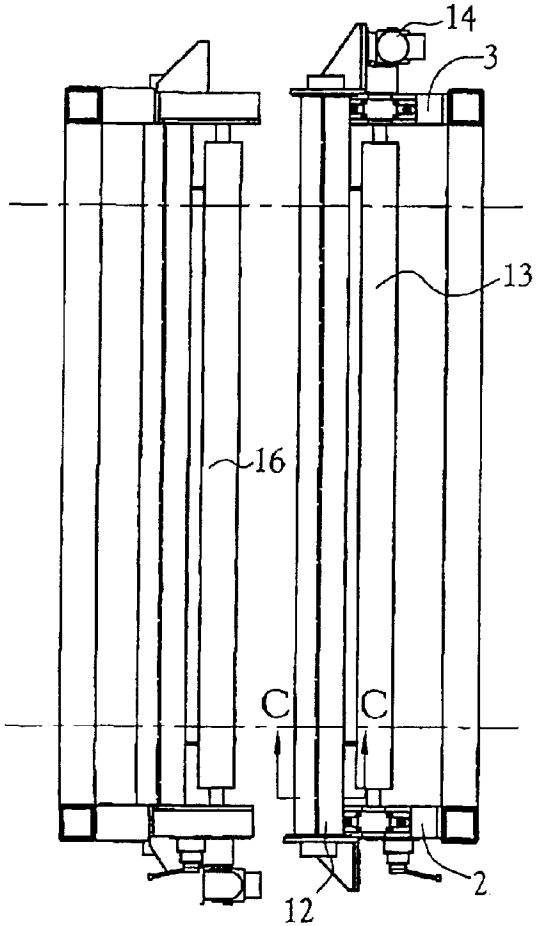
FIG. 2 is a plan view taken along line B—B in FIG. 1.

Referring now to the Figures in which like reference numerals indicate like or corresponding features, there is shown in FIG. 1 an apparatus for removing broken filaments from a plurality of continuously longitudinally moving tows. Each tow typically contains between about 25,000 and about 80,000 filaments and is about one inch in width. The tows are arranged in a side-by-side configuration with a flat profile. The apparatus is mounted on a frame 1 including a plurality of rigid horizontal and vertical members adapted for securely mounting the apparatus.

A mounting bracket 2 is secured to one side of the frame 1 and a mounting bracket 3 is secured to the opposing side of the frame 1. A roller 13 is rotatably mounted upon the mounting brackets 2 and 3 in an orientation in which the axis of rotation is generally perpendicular to the direction of movement of the tows 60 as they travel from a processing station 62 to a collecting station 64. The diameter of the roller 13 may vary with the particular materials used, but a diameter of 3 to 8 inches is preferred. The roller 13 in the depicted embodiment is approximately four inches in diameter and sufficiently long to span a plurality of tows.

The roller 13 is covered with a rubber material of hardness and texture suitable for removing broken filaments from the tow. The rubber material may comprise neoprene, ethylene-propylene-diene-methylene (EPDM), nitrile neoprene, buna neoprene, natural rubber, silicone or polyurethane, for example. In one embodiment, the covering material comprises a neoprene rubber, which provides good tactile properties and abrasion resistance.

The applicable durometer (hardness) of the rubber material is about 55 to 90 on the Shore A scale, with a preferable range of 70 to 80 Shore A hardness. The rubber material has a smooth surface.

An adjustable speed gear motor 14 is provided to rotate the roller 13 in a direction opposite from, or counter to, the direction of movement of the tow at the point of frictional engagement between the tow 60 and the roller 13. Each tow set is provided with a top roller 13 for removing fuzz on the top surface and a bottom roller 16 for removing fuzz on the bottom surface. Accordingly, a top roller 13, located above the tows 60, rotates clockwise as viewed in FIG. 1 and a bottom roller 16 located below the tows 60 rotates counter-clockwise as viewed in FIG. 1.

The speeds of rotation of the rollers 13 and 16 are dependent upon the diameter of the rollers 13 and 16 because it is the surface speed of the rollers 13 and 16 that determines the efficiency of the rollers in removing fuzz. If the tow is moving at a velocity v, the surface speed of the rollers 13 and 16 is in a range of 0 to 8 times v and preferably in a range of 1.5 times v to 2.5 times v.

The fiber tows contact each of the rollers 13 and 16 along an arc of 10–30 degrees (referred to as the wrap angle) and the tension in each fiber tow is within a range of 2–15 pounds, with a preferred range of 3–10 pounds.

An elongated, tubular vacuum header 12 is mounted upon the brackets 2 and 3 and extends parallel to and adjacent to roller 13. The vacuum header 12 is located upstream of the roller 13. The vacuum header 12 includes an elongated vacuum nozzle tip 8 extending along most of the length of the header 12 for a distance sufficient to span the width of the plurality of tows. The nozzle tip 8 provides flow communication between the outboard end 9 of the nozzle tip 8 and the interior of the vacuum header 12. The outboard end 9 of the nozzle tip 8 is located parallel to the roller 13 and adjacent to the point of frictional contact between the tows and the roller 13.

In an alternative embodiment, the rollers 13 and 16 may be operated with an indexing motion in which the rollers 13 and 16 are fixed, i.e., a surface velocity of 0, as the tows 60 are pulled over the rollers 13 and 16. Then periodically, e.g., every 5 to 10 seconds, the rollers 13 and 16 are indexed by an indexing driver (not shown) 45 to 90 degrees in a direction opposite to the direction of travel of the tows 60. In this case, the nozzle tips are located 45 to 90 degrees "upstream" of the area of contact between the tows and the rollers 13 and 16. The periodic indexing of the rollers 13 and 16 transports the broken ends of the fibers to the nozzle tip for entrainment in the airflow.

In operation, a tow 60 is processed employing the present invention as it travels from a processing station 62 to a collection station 64. Each tow is frictionally engaged by a top roller 13 rotating in a direction opposite from the direction of movement of the tow 60 at the wrap area of frictional engagement. Broken ends of filaments in the tow are lifted out of the tow by a combination of the rotating, rubber coated roller 13 and vacuum applied within the vacuum header 12 to develop an air flow into and through the nozzle tip 8. The air velocity through the nozzle tip 8 is preferably in a range of 5,000 to 10,000 fpm. As broken filaments are lifted by the roller 13, they are entrained in the air flow through the nozzle tip 8 and carried into the vacuum header 12 from which they are collected by a vacuum canister (not shown).

EXAMPLE

Using a control group and employing an apparatus and method described herein above, fuzz measurements were compiled for carbon fiber tows of various filament counts and levels of epoxy polymer sizing. The specific configuration of the apparatus and associated process conditions were as follows:

| | |
|---|---|
| Roll diameter: | 4 inches |
| Rubber coating | Neoprene |
| Roll hardness and finish | 75 durometer, Shore A; smooth |
| Fiber line tow speed | v |

-continued

| | |
|---|---|
| Roll surface speed | 1.5 v to 2.5 v |
| Wrap angle | 10–15 degrees |
| Tow tension | 3–10 pounds |

The fuzz levels for both populations, i.e. with and without the application of the present invention were determined by passing the individual tows over a smooth freely turning roller while applying to the reverse side of the tow a stationary foam pad to capture any loose filaments on the tow. The captured filaments were then collected, weighed and scaled to produce a value expressed in milligrams of fuzz per 150 feet of tow length, the industry standard. The effectiveness of the method and apparatus of the invention is shown in Table 1. Mean fuzz levels were reduced to less than 20 mg per 150 feet, resulting in improved handleability and performance in prepregging, filament winding and pultrusion applications.

TABLE 1

FUZZ LEVELS (mg/150 feet)

| Carbon Fiber Tow Filament | Epoxy Size | Without Fuzz System | | With Fuzz System | |
|---|---|---|---|---|---|
| Count | Wt. % | Mean | Measurements | Mean | Measurements |
| 80,000 | 0.4 | 65.3 | 2,221 | 19.9 | 3,462 |
| 80,000 | 2.0 | 49.9 | 301 | 19.9 | 343 |
| 40,000 | 0.4 | 55.0 | 1,407 | 12.3 | 280 |
| 40,000 | 2.0 | 35.7 | 165 | 14.9 | 56 |

Although the examples described herein include the use of epoxy as a sizing agent, it will be recognized that other thermosetting materials, including phenolics, polyurethanes, vinylesters and polyesters and thermoplastics, including polyurethanes, polypropylene, polyamides and polyesters, may be used.

It will be recognized by one skilled in the art that varying materials may be used to cover the roller 13 and that the size of the roller 13 and the speed of rotation of the rollers may be adjusted to adapt to the speed of the tows and the condition of the tows. Similarly, the area of frictional contact between the tows and the rollers 13 may be adjusted by adjusting the angle between the tow as it approaches the roller 13 and the tow as it leaves the roller 13. In addition, although the rollers in the depicted embodiment are oriented horizontally and the tows are oriented horizontally, it will be recognized that both the rollers and the tows could be oriented vertically. Also, multiple rollers and vacuum nozzles may be employed on the top surface and/or the bottom surface to increase the removal efficiency of the process.

While a preferred embodiment has been shown and described, it will be understood that it is not intended to limit the disclosure, but rather is intended to cover all modifications and alternate methods and apparatus within the spirit and scope of the invention.

We claim:

1. An apparatus for removing broken filaments from a continuous tow traveling at a tow velocity between a source and a collector comprising:

a rotatable, cylindrical roller, having an axis of rotation and an outer surface, located in the path of travel by said tow from said source to said collector to contact said tow, said axis of rotation being oriented generally perpendicular to the direction of travel of said tow, a driver for rotating said roller in a direction counter to the direction of travel of said tow, and a vacuum nozzle located adjacent to said roller.

2. An apparatus m accordance with claim 1 wherein said outer surface of said roller comprises a rubber material.

3. An apparatus in accordance with claim 2 wherein said rubber is selected from the group comprising neoprene, ethylene-piopylene-diene-methylene, nitrile neoprene, buna neoprene, natural rubber and polyurethane.

4. An apparatus in accordance with claim 1 wherein said roller outer surface has a hardness of 55 to 90 durometer on a Shore A scale and a smooth texture.

5. An apparatus m accordance with claim 1 wherein said roller has a diameter of 3 to 8 inches.

6. An apparatus m accordance with claim 1 wherein said outer surface is in contact with said tow over an arc defining an angle of 10 to 30 degrees.

7. An apparatus in accordance with claim 1 wherein said outer surface of said roller travels at a velocity that is less than 8 times the tow velocity.

8. An apparatus in accordance with claim 1 wherein said driver comprises an indexing driver.

9. A method for removing broken filaments from continuous tow traveling at tow velocity between a source and a collector comprising:

contacting said tow with a rotatable, cylindrical roller, having an axis of rotation and an outer surface, located in the path of travel by said tow from said source to said collector, said axis of rotation of said roller being oriented generally perpendicular to the direction of travel of said tow, rotating said roller in a direction counter to said direction of travel of said tow to lift broken fibers from said tow, and entraining said lifted broken fibers in an airflow to remove said broken fibers from said tow.

10. A method in accordance with claim 9 wherein said outer surface of said roller comprises a rubber material.

11. A method in accordance with claim 10 wherein said rubber is selected from the group comprising neoprene, ethylene-propylene-diene-methylene, nitrile neoprene, buna neoprene, natural rubber and polyurethane.

12. A method in accordance with claim 9 wherein said roller outer surface has a hardness of 55 to 90 durometer on a Shore A scale and a smooth texture.

13. A method in accordance with claim 9 wherein said roller has a diameter of 3 to 8 inches.

14. A method in accordance with claim 9 wherein said outer surface is in contact with said tow over an arc defining an angle of 10 to 30 degrees.

15. A method in accordance with claim 9 wherein said outer surface of said roller travels at a velocity that is less than 8 times the tow velocity.

16. A method in accordance with claim 9 wherein said roller motion is indexed.

* * * * *